US005716236A

United States Patent [19]

O'Sullivan et al.

[11] Patent Number: 5,716,236

[45] Date of Patent: Feb. 10, 1998

[54] SYSTEM FOR TERMINATING THE SHIELD OF A HIGH SPEED CABLE

[75] Inventors: Michael O'Sullivan, Willowbrook; Paul Murphy, Naperville, both of Ill.

[73] Assignee: Molex Incorporated, Lisle, Ill.

[21] Appl. No.: 609,301

[22] Filed: Mar. 1, 1996

[51] Int. Cl.[6] ..... H01R 13/648

[52] U.S. Cl. ..... 439/610; 439/108

[58] Field of Search ..... 439/607–610, 439/98, 99, 108, 101

[56] References Cited

U.S. PATENT DOCUMENTS

| | | | |
|---|---|---|---|
| 4,451,099 | 5/1984 | Bricker, Jr. et al. | 339/14 |
| 4,684,199 | 8/1987 | Ezure et al. | 439/610 |
| 4,813,888 | 3/1989 | Tokizane et al. | 429/583 |
| 4,921,447 | 5/1990 | Capp et al. | 439/585 |
| 4,960,392 | 10/1990 | Dickie | 439/610 |
| 5,025,554 | 6/1991 | Dohi | 29/860 |
| 5,073,128 | 12/1991 | Sirai et al. | 439/585 |
| 5,085,596 | 2/1992 | Bowen et al. | 439/497 |
| 5,114,366 | 5/1992 | Sato | 439/585 |
| 5,115,562 | 5/1992 | Bowen et al. | 29/867 |
| 5,120,241 | 6/1992 | Nakata et al. | 439/585 |
| 5,120,259 | 6/1992 | Nakata et al. | 439/585 |
| 5,145,409 | 9/1992 | Sato et al. | 439/585 |
| 5,180,316 | 1/1993 | Miller et al. | 439/610 |
| 5,197,904 | 3/1993 | Gold | 439/581 |
| 5,222,898 | 6/1993 | Fedder et al. | 439/101 |
| 5,304,069 | 4/1994 | Brunker et al. | 434/108 |
| 5,415,569 | 5/1995 | Kinoshita | 439/610 |
| 5,495,075 | 2/1996 | Jonckheere et al. | 439/610 |
| 5,509,827 | 4/1996 | Huppenthal et al. | 439/638 |

FOREIGN PATENT DOCUMENTS

| | | |
|---|---|---|
| 0 670 616 A1 | 9/1995 | European Pat. Off. . |
| 0 694 989 A2 | 1/1996 | European Pat. Off. . |
| 0 385 020 B1 | 7/1996 | European Pat. Off. . |

*Primary Examiner*—Hien Vu

*Attorney, Agent, or Firm*—Charles S. Cohen

[57] ABSTRACT

A system is disclosed for terminating the metallic shields of a pair of high speed cables each having a portion of the outer jacket removed to expose a portion of the metallic shield thereof. A rigid sleeve is positioned between the metallic shield and the dielectric of each of the cables. An elongated, generally planar ground plate has a pair of crimp arms projecting inwardly from opposite edges of the plate near one end thereof for crimping onto the exposed portions of the metallic shields of the pair of cables. The crimp arms clamp the shields between the arms and the rigid sleeves and position the pair of cables on the ground plate between the arms.

33 Claims, 6 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved method of terminating the metallic shield of a high speed cable, as well as a terminal for the shield of the cable.

In the exemplary embodiment of the invention, a system is disclosed for terminating the shields of a pair of high speed cables. Each cable has an outer jacket, an inner metallic shield with a portion of the outer jacket removed to expose a portion of the metallic shield, and an inner dielectric between the metallic shield and a center conductor. A rigid sleeve is positioned between the metallic shield and the dielectric of each of the cables. An elongated, generally planar ground plate has a pair of crimp arms projecting inwardly from opposite edges of the plate near one end thereof for crimping onto the exposed portions of the metallic shields of the pair of cables. Each crimp arm clamps the shield between the crimp arm and the rigid sleeve. The crimp arms position the pair of cables on the ground plate between the arms.

As disclosed herein, a pair of the crimp arms project from opposite edges of the plate on each opposite side of the plate. The pairs of crimp arms are spaced longitudinally of the plate. The ground plate is fabricated of stamped and formed sheet metal material, and the rigid sleeves are fabricated of metal material.

In an alternate embodiment of the invention, the rigid sleeves comprise portions of a unitary dual-sleeve member having a pair of sleeve portions joined by a web. The sleeve portions are positioned between the metallic shields and the inner dielectrics of both of the cables. Complementary interengaging holding means are provided between the ground plate and the unitary dual-sleeve member for holding the member on the ground plate. As disclosed herein, the holding means includes a unitary spring clip on the ground plate engageable with the web of the dual-sleeve member. Preferably, the pair of sleeve portions and the web of the unitary dual-sleeve member have the same shape and profile as the crimp arms and the ground plate so that the dual-sleeve member can nest within the area between the crimp arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
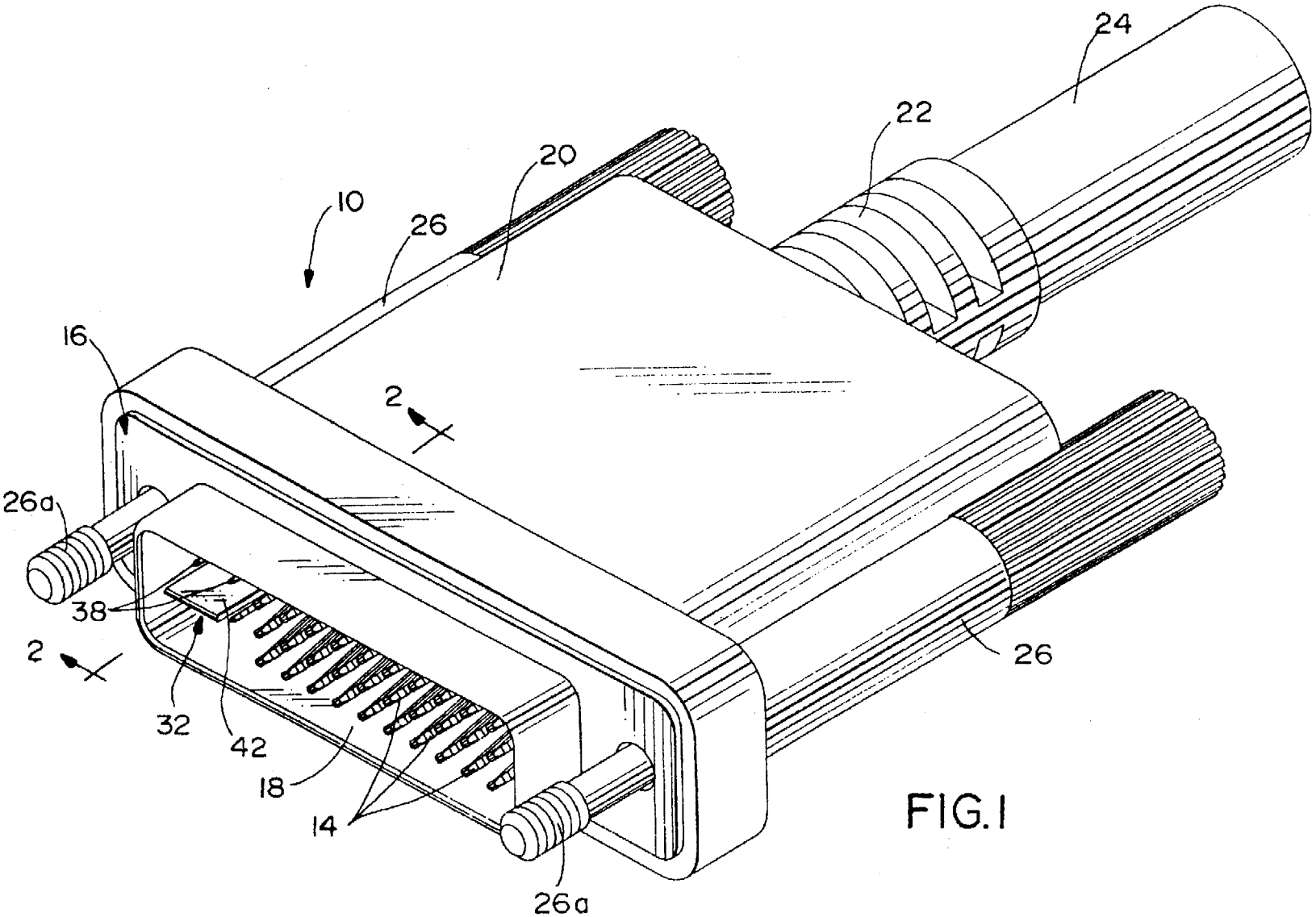
FIG. 1 is a perspective view of an electrical connector of a type in which the invention is applicable.
Figure 2:
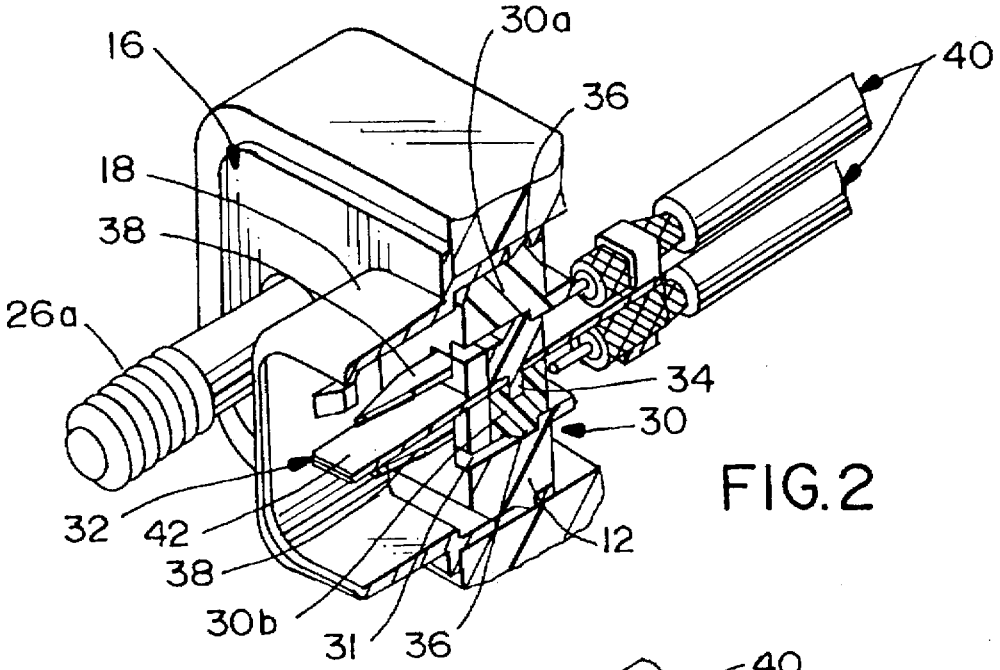
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of terminal blocks 30*a* and 30*b* which clamp a ground plate, generally designated 32, therebetween. Each terminal block includes a post 34 and a recess. The post from each terminal block extends from each terminal block through a hole or slot 44 (FIG. 5) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36 on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 9) are terminated to the center conductor/cores 52 of a plurality of coaxial cables, generally designated 40 in FIG. 2. The invention is particularly directed to the manner of termination of the metallic shields 56 of the coaxial cables to ground plate 32, as described below.

Figure 5:
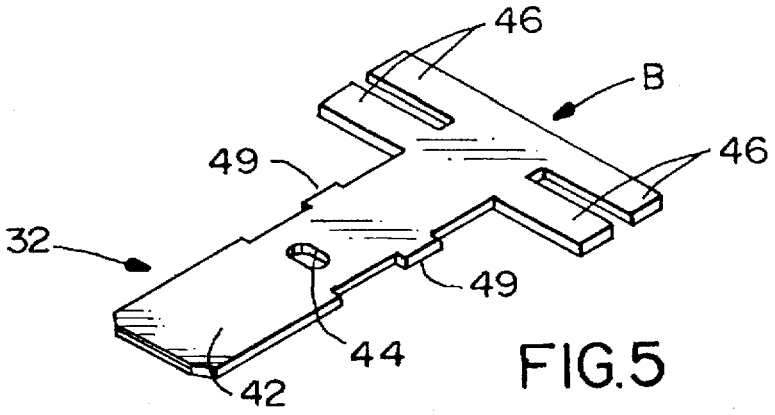
FIG. 5 is a perspective view of a stamped metal blank from which the terminating member or ground plate is formed.

More particularly, FIG. 5 shows a blank, generally designated "B," stamped from conductive sheet metal material and from which ground plate 32 is formed. Blank "B" is generally T-shaped and includes a leg or stem portion 42 which will form a blade portion for ground plate 32. The blade portion includes an aperture 44 through which posts 34 (FIG. 2) of terminal blocks 30*a* and 30*b* extend. A pair of wings or arms 46 project outwardly at one end of leg 42 generally at each opposite edge thereof. These wings will form the crimp arms of the ground plate, as will be seen hereinafter. Lastly, barbs or teeth 49 are stamped at the opposite edges of blade portion 42 to facilitate holding the subassembly of the ground plate and terminals blocks 30*a* and 30*b* within the housing.

Figure 3:
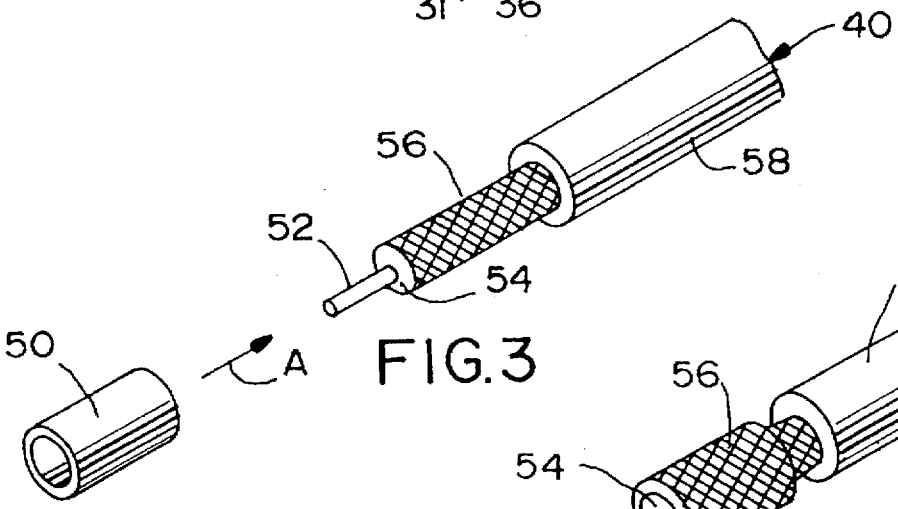
FIG. 3 is a perspective view of one of the coaxial cables prepared for use with the invention, in conjunction with one of the rigid sleeves.
Figure 4:
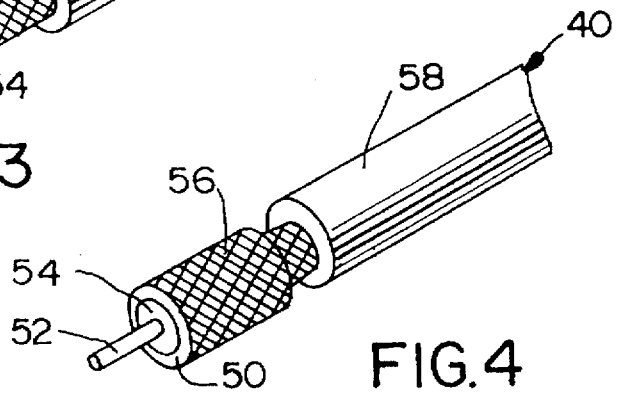
FIG. 4 is a perspective view of the coaxial cable prepared as shown in FIG. 3, with the rigid sleeve inserted between the metallic shield and the dielectric of the cable.

FIGS. 3 and 4 show one of the coaxial cables 40 having been prepared for use with the termination system of the invention, in conjunction with a rigid cylindrical sleeve 50. At this point, it should be understood that each coaxial cable 40 is of a conventional construction in that each cable includes a center conductor or core 52 surrounded by a tube-like inner dielectric 54. A metallic shield in the form of a tubular metallic braid 56 surrounds inner dielectric 54. An insulating jacket 58, as of plastic or the like, surrounds metallic braid 56 to form the overall composite coaxial cable 40.

According to the invention, rigid sleeve 50 is insertable in the direction of arrow "A" (FIG. 3) into a position between metallic shield 56 and dielectric 54 of coaxial cable 40 until the rigid sleeve reaches a position whereat the front end thereof is generally flush with the front of inner dielectric 54 as shown in FIG. 4. It can be seen that center conductor/core 52 projects longitudinally outwardly of the inner dielectric and the sleeve for termination purposes. The sleeve may be fabricated of rigid metal material. In essence, the rigid sleeve protects dielectric 54 from external crimping or clamping forces as will be understood hereinafter.

Figure 6:
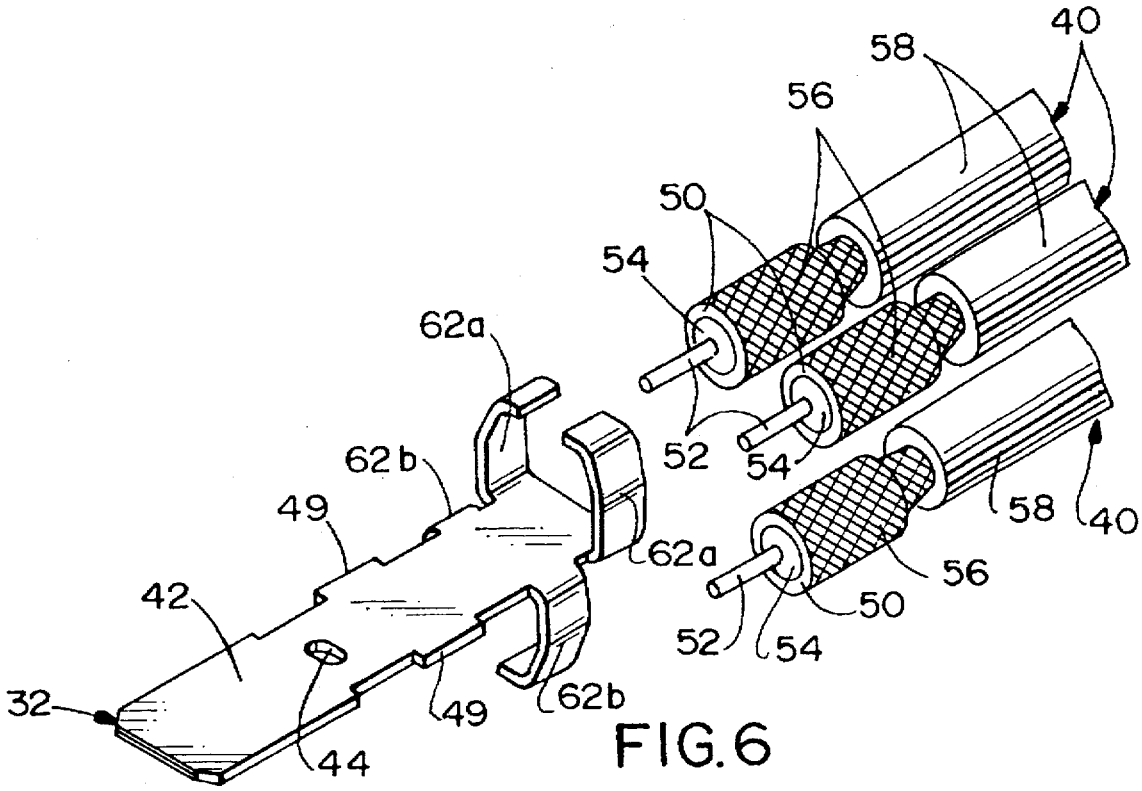
FIG. 6 is a perspective view of the ground plate, with the crimp arms formed to their preliminary or open positions, and in conjunction with a plurality of coaxial cables having the rigid sleeves inserted therein.

FIG. 6 shows the stamped blank "B" of FIG. 5 with wings 46 (FIG. 5) having been bent inwardly to form a pair of upper crimp arms 62*a* and a pair of lower crimp arms 62*b*. In essence, ground plate 32 is provided with a pair of opposed crimp arms at opposite edges of the plate for clamping onto a pair of coaxial cables, as well as providing a pair of the opposed crimp arms on each opposite side of the plate. One pair 62*a* is located at the extreme rear distal end of blade portion 42, and the other pair 62*b* is located slightly spaced longitudinally forward of the first pair. With this structure, the ground plate can terminate from one to four coaxial cables depending on the specifications of the connector. In computer applications, three cables may be used to carry the red, green and blue chroma signals for a monitor. A fourth cable might be used for flat screen monitors for carrying the pixel clock timing signal. FIG. 6 shows three coaxial cables 40 for illustration purposes, with each cable having been prepared as shown in FIG. 3, and with a rigid sleeve 50 inserted between the metallic shield and the inner dielectric of each cable as shown in FIG. 4.

Figure 7:
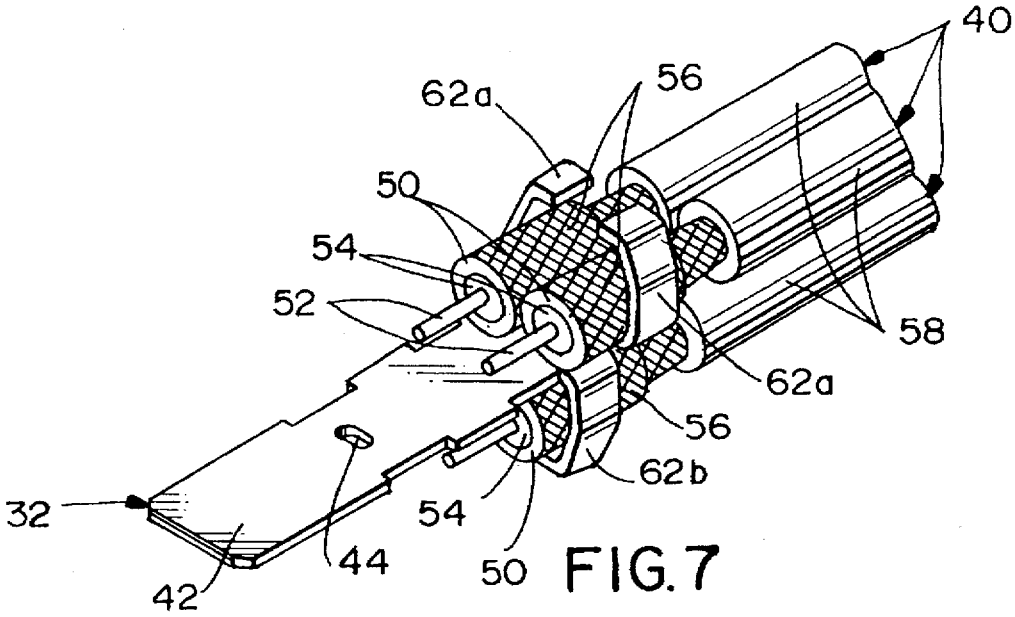
FIG. 7 is a view similar to that of FIG. 6, but showing the coaxial cables properly positioned relative to the crimp arms of the ground plate.

FIG. 7 shows coaxial cables 40 having been moved to positions whereat the metallic shields 56 and the underlying rigid sleeves 50 are in registry or alignment with crimp arms 62*a* and 62*b*. The crimp arms function to properly position the coaxial cables with respect to blade portion 42 of ground plate 32. The crimp arms are shown in preliminary or preformed positions in FIG. 7.

Figure 8:
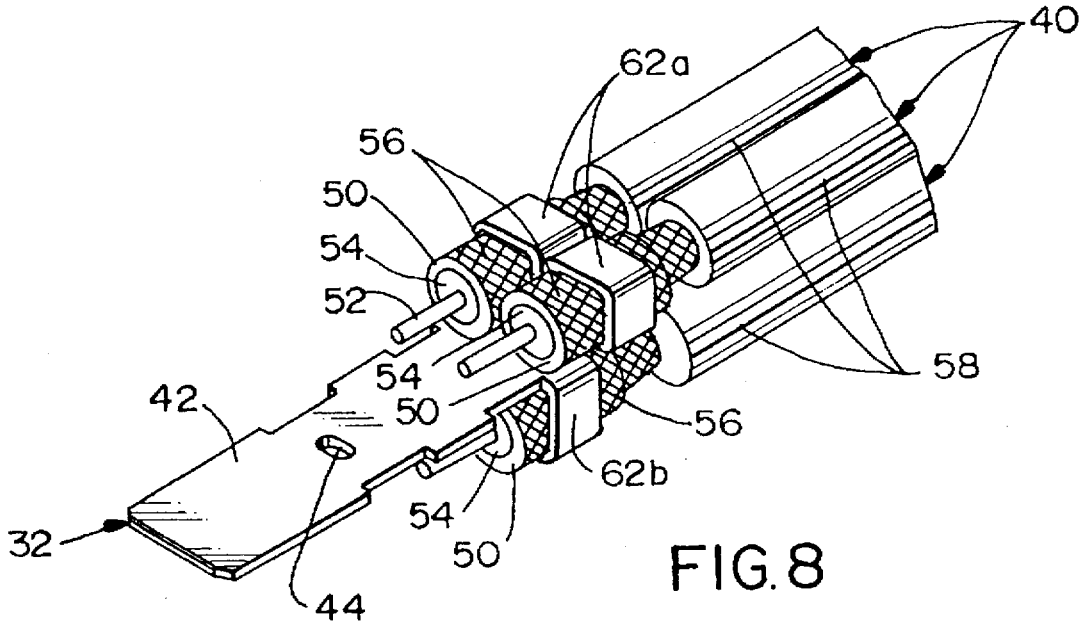
FIG. 8 is a perspective view similar to that of FIG. 7, but with the crimp arms crimped into engagement with the metallic shields of the cable.

The next step in processing the terminal module is to crimp or form crimp arms 62*a* and 62*b* into clamping engagement with the coaxial cables about the exposed metallic shields 56 outside rigid sleeves 50, as shown in FIG. 8. The crimp arms are clamped onto the metallic shields 56 with sufficient force to provide an excellent electrical connection between the shields and the arms, with rigid sleeves 50 backing the metallic shields. In essence, the sleeves act as anvils opposing the clamping forces. The rigid sleeve protects inner dielectric 54 from being crushed or otherwise damaged by crimp arm 62*a* or 62*b*.

Figure 9:
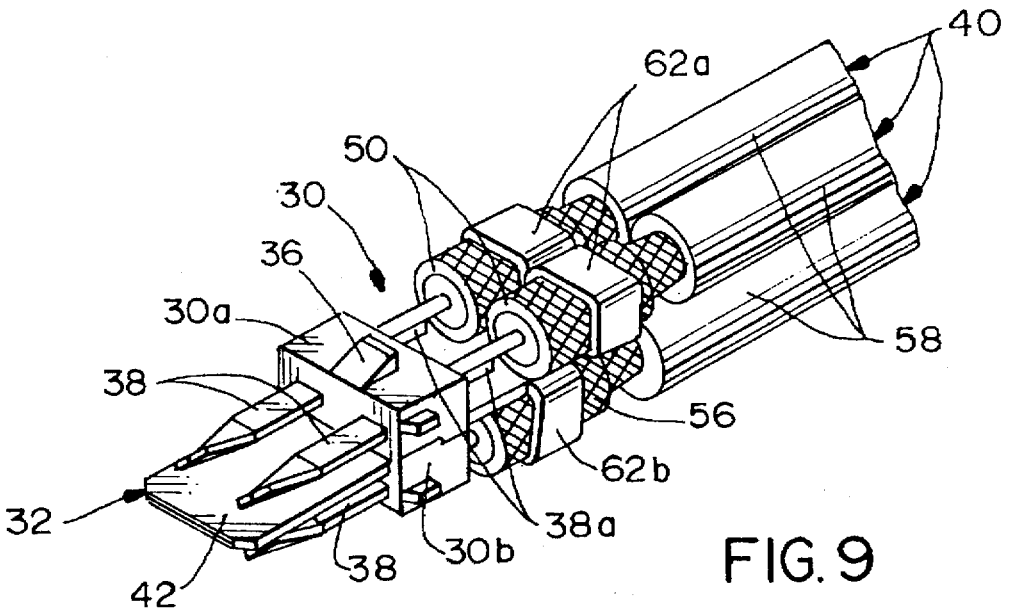
FIG. 9 is a perspective view of the subassembly of FIG. 8 assembled into the terminal module shown in FIG. 2.

Once the subassembly of FIG. 8 is fabricated, this subassembly is assembled to terminal blocks 30*a* and 30*b* and high speed signal transmission terminals 38 to form terminal module 30 as shown in FIG. 9 and described above in relation to FIG. 2. Center conductors/cores 52 of the coaxial cables are connected, as by soldering to the inner ends 38*a* of terminals 38, with terminal blocks 30*a* and 30*b* clamping blade portion 42 of ground plate 32 therebetween, as shown in FIG. 2 and described above. The terminal module then is mounted within dielectric housing 12 as shown in FIG. 2.

Figure 10:
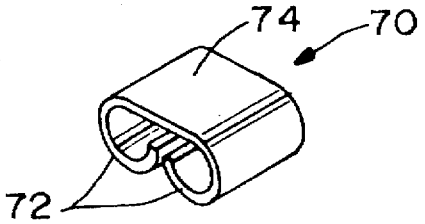
FIG. 10 is a perspective view of a unitary dual-sleeve member of an alternate embodiment of the invention.

FIGS. 10–16 show an alternate embodiment of the invention wherein a pair of the rigid sleeves on each side of ground plate 32 are replaced by a unitary dual-sleeve member, generally designated 70 in FIG. 10. Each unitary dual-sleeve member includes a pair of cylindrical sleeve portions 72 joined by a web 74.

Figure 11:
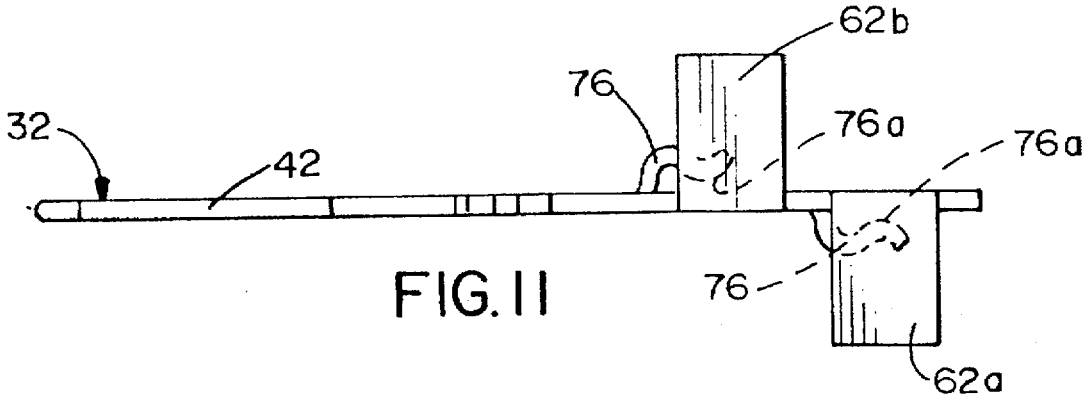
FIG. 11 is a side elevational view of the ground plate for use with the unitary dual-sleeve member of FIG. 10.
Figure 12:
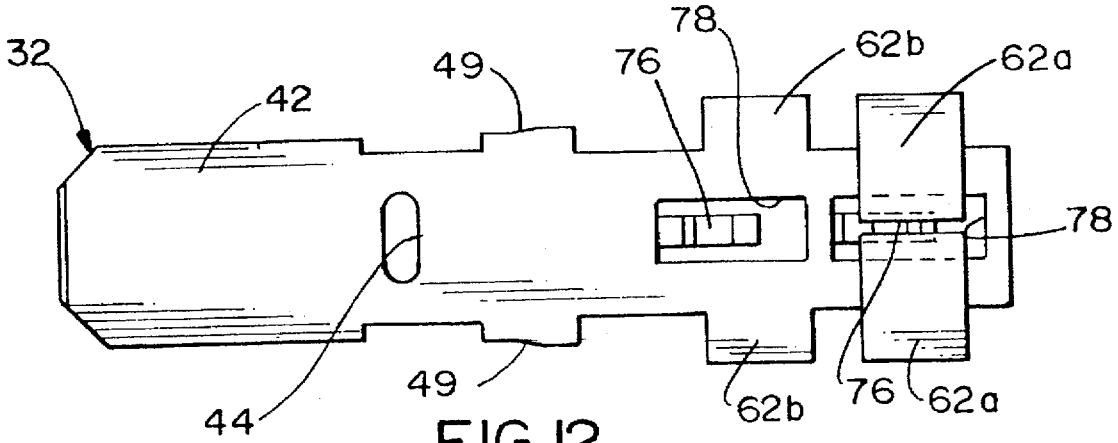
FIG. 12 is a plan view of the ground plate of FIG. 11.

FIGS. 11 and 12 show ground plate 32 as described above, except with the addition of a pair of spring clips 76 stamped and formed out of respective openings 78 in blade portion 42 of the ground plate. Otherwise, like reference numerals have been applied in FIGS. 11 and 12 to designate like components described above in relation to ground plate 32 in FIGS. 5–9. The spring clips are effective to engage the webs 74 between the sleeve portions 72 of dual-sleeve members 70 to hold the members to the surface of blade portion 42 of the ground plate. In essence, engaging surfaces 76*a* (shown best in FIG. 11) are spaced away from the respective adjacent surface of blade portion 42 an amount less than the thickness of a respective web 74, to thereby resiliently clamp the web and, in turn, the dual-sleeve member against the blade portion of the ground plate.

Figure 13:
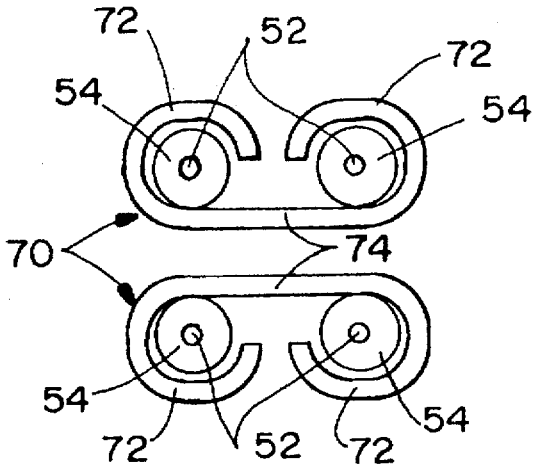
FIG. 13 is an end view of a pair of the unitary dual-sleeve members of FIG. 2 installed about the dielectrics of four coaxial cables.

FIG. 13 shows two unitary dual-sleeve members 70 with their sleeve portions 72 positioned about the inner dielectric 54 of four coaxial cables.

Figure 14:
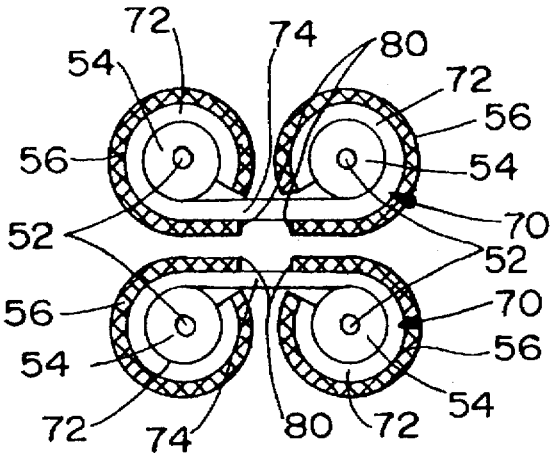
FIG. 14 is a view similar to that of FIG. 13, but showing the metallic braids of the coaxial cables positioned about the dual-sleeve members.

FIG. 14 is similar to the depiction of FIG. 13, but the metallic shields 56 of two coaxial cables have been positioned about sleeve portions 72 of each unitary dual-sleeve members 70. It can be seen that the metallic braids are longitudinally slit, as at 80, so that webs 74 of the dual-sleeve members can slide into the metallic braids with sleeve portions 72 positioned inside the shields.

Figure 15:
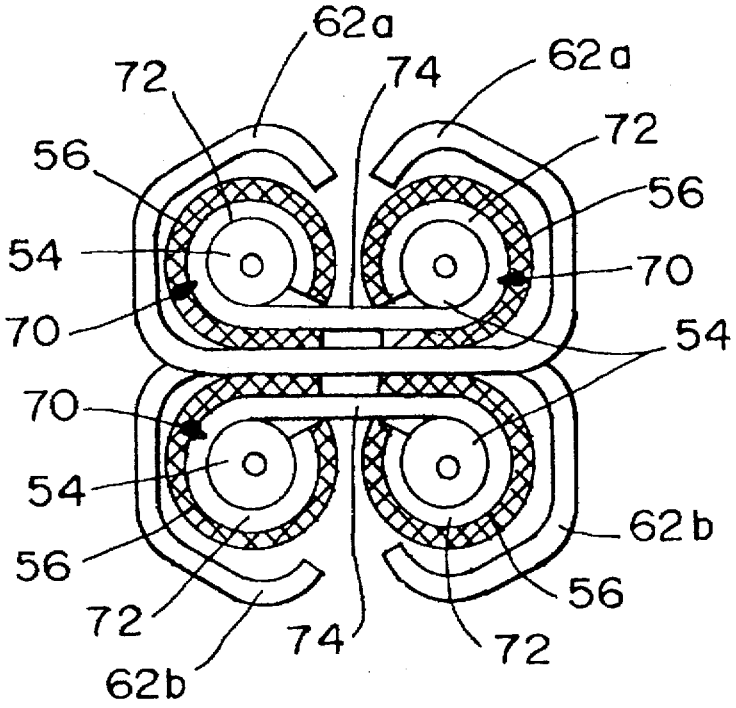
FIG. 15 is a view similar to that of FIG. 14, but showing the coaxial cables and dual-sleeve members inserted within the crimp arms of the ground plate.

FIG. 15 shows the two unitary dual-sleeve members 70 and the four coaxial cables positioned within preformed crimp arms 62*a* and 62*b*. This condition of the subassembly corresponds generally with the above description of the first embodiment in relation to FIG. 7 except that dual sleeve members 70 are held in place by spring clips 76.

Figure 16:
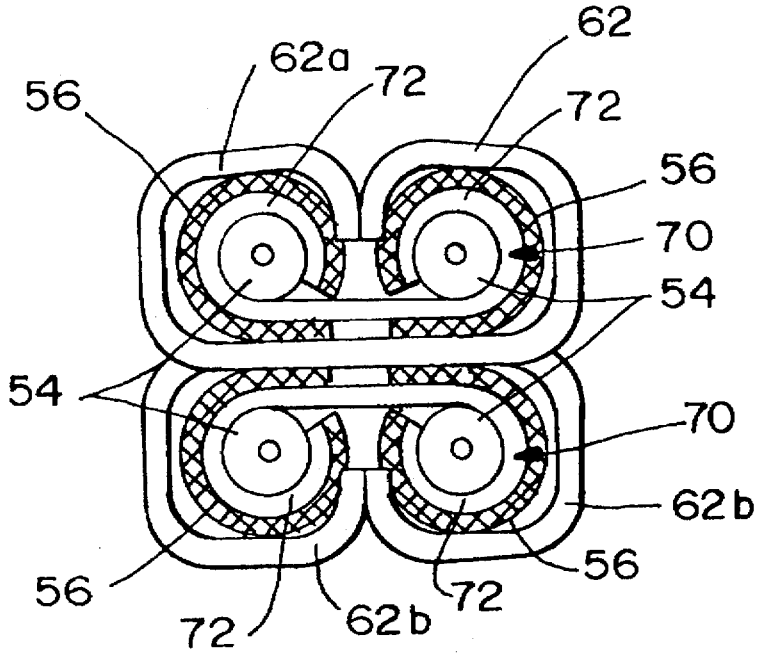
FIG. 16 is a view similar to that of FIG. 15, but showing the crimp arms formed into crimping engagement with the metallic shields.

Finally, FIG. 16 shows crimp arms 62*a* and 62*b* having been onto metallic shields 56 of the four coaxial cables, with the two sleeve portions 72 of each dual-sleeve member 70 acting as an anvil behind the metallic shields and protecting the inner dielectric 54 of each coaxial cables. This depiction of the second embodiment of the invention corresponds generally to the above description of the first embodiment in relation to FIG. 8.

The concepts of the invention have been shown and described herein in conjunction with terminating the metallic shield of the coaxial cable to a terminating member 32 in the form of a ground plate 42. However, it should be understood that the concepts of the invention may be equally applicable for terminating the metallic shield 56 to other types of terminating members, such as electrical terminals themselves.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A termination assembly comprising:

a pair of cables, each of said cables having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a pair of rigid sleeve members, one of said sleeve members being positionable between said metallic shield and said inner dielectric of one of said pair of cables and the other of said sleeve members being positionable between said metallic shield and said inner dielectric of said other of said pair of cables; and a conductive terminal member to which said metallic shields are to be terminated, said terminal member being at least partially disposed in a dielectric housing of an electrical connector and including an elongated, generally planar ground plate having a pair of crimp arms projecting from opposite edges of said ground plate near one end thereof, said crimp arms being adapted to be crimped onto said exposed portions of said metallic shields of said cables thereby clamping said metallic shields between said crimp arms and said sleeve members and whereby said pair of rigid sleeve members protect said inner dielectrics from being damaged by said crimp arms.

2. The termination assembly of claim 1 wherein said rigid sleeve member is a metallic sleeve.

3. The termination assembly of claim 1 including at least one additional cable to be terminated to said ground plate, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including an additional rigid sleeve member disposed between said additional metallic shield and said additional inner dielectric of said additional cable and including a pair of additional crimp arms projecting from opposite edges of said ground plate on a side opposite of said ground plate from which said crimp arms project, at least one of said additional crimp arms being adapted to be crimped onto said additional exposed portion of said additional metallic shield of said additional cable thereby clamping said additional metallic shield between one of said additional crimp arms and said additional rigid sleeve member.

4. The termination assembly of claim 3 wherein said additional crimp arms are spaced longitudinally on said ground plate from said crimp arms.

5. The termination assembly of claim 3 wherein said rigid sleeve members and said additional rigid sleeve members are each metal sleeves.

6. The termination assembly of claim 1 wherein said ground plate comprises a stamped and formed sheet metal component.

7. The termination assembly of claim 1 wherein said rigid sleeve members are portions of a unitary dual-sleeve member having a pair of sleeve portions joined by a web, one of said sleeve portions being positionable between said metallic shield and said inner dielectric of one of said pair of cables and the other of said sleeve portions being positionable between said metallic shield and said inner dielectric of said other of said pair of cables.

8. The termination assembly of claim 7 including interengaging holding means between said ground plate and said unitary dual-sleeve member for holding said dual-sleeve member on said ground plate.

9. The termination assembly of claim 8 wherein said holding means includes a spring clip on said ground plate engageable with said web of said dual-sleeve member.

10. The termination assembly of claim 7 wherein said pair of sleeve portions and said web of said unitary dual-sleeve member have the same general shape and profile as said crimp arms and said ground plate extending between said crimp arms so that said dual-sleeve member is adapted to nest within an area defined between said crimp arms.

11. The termination assembly of claim 7 including an additional pair of cables to be terminated to said ground plate, each of said additional pair of cables including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including an additional unitary dual-sleeve member having a pair of additional sleeve portions joined by an additional web, one of said additional sleeve portions being positionable between said additional metallic shield and said additional inner dielectric of one of said pair of additional cables and the other of said additional sleeve portions being positionable between said additional metallic shield and said additional inner dielectric of said other of said pair of additional cables and including a pair of additional crimp arms projecting from opposite edges of said ground plate on a side opposite of said ground plate from which said pair of crimp arms project, each of said additional crimp arms being adapted to be crimped onto said additional exposed portion of one of said additional metallic shields of said additional cables thereby clamping said additional metallic shield between one of said additional crimp arms and one of said additional sleeve portions.

12. The termination assembly of claim 11 wherein said pair of crimp arms and said pair of additional crimp arms are spaced longitudinally on said ground plate from each other.

13. The termination assembly of claim 11 including a pair of spring clips on said ground plate, one of said clips engageable with said web of said dual-sleeve member for holding said dual-sleeve member on said ground plate and the other of said clips engageable with said additional web of said additional dual-sleeve member for holding said additional dual-sleeve member on said ground plate.

14. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least a portion of said terminal receiving passages;

a rigid sleeve disposed between said metallic shield and said inner dielectric of each of said cables; and a conductive terminal member at least partially disposed in said housing relative to said terminals, said terminal member including an elongated, generally planar ground plate having a pair of crimp arms projecting from opposite edges of said ground plate near one end thereof, said crimp arms being adapted to be crimped onto said exposed portions of said metallic shields of said cables thereby clamping said metallic shields between said crimp arms and said sleeves to thereby position and retain said cables on said ground plate and whereby said rigid sleeves protect said inner dielectrics from being damagaed by said crimp arms.

15. The electrical connector of claim 14 wherein said rigid sleeve is a metallic sleeve.

16. The electrical connector of claim 14 wherein said sleeves are portions of a unitary dual-sleeve member having a pair of sleeves joined by a web, one of said sleeves being positionable between said metallic shield and said inner dielectric of one of said pair of cables and the other of said sleeves being positionable between said metallic shield and said inner dielectric of said other of said pair of cables.

17. The electrical connector of claim 16 including interengaging holding means between said ground plate and said unitary dual-sleeve member for holding said dual-sleeve member on said ground plate.

18. The electrical connector of claim 16 wherein said holding means includes a spring clip on said ground plate engageable with said web of said dual-sleeve member.

19. The electrical connector of claim 16 wherein said sleeves are generally cylindrical and joined by a generally tangential web.

20. The electrical connector of claim 14 wherein an additional pair of cables are to be terminated to said ground plate, each of said additional pair of cables including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said connector further including an additional rigid sleeve disposed between each of said additional metallic shields and each of said additional inner dielectrics of said additional cables and including a pair of additional crimp arms projecting from opposite edges of said ground plate on a side opposite of said ground plate from which said crimp arms project, each of said additional crimp arms being adapted to be crimped onto said additional exposed portion of one of said additional metallic shields of said additional cables thereby clamping each of said additional metallic shields between one of said additional crimp arms and one of said additional rigid sleeves.

21. The electrical connector of claim 20 wherein said additional crimp arms are spaced longitudinally on said ground plate from said crimp arms.

22. A method of terminating a pair of cables each having an inner conductor, an inner dielectric surrounding at least a portion of said inner conductor, a metallic shield surrounding at least a portion of said inner dielectric and an outer insulating jacket surrounding at least a portion of said metallic shield to a conductive terminating member disposed within a dielectric housing of an electrical connector, said method comprising the steps of:

providing said cables with a portion of said outer insulating jacket of each of said cables removed from about said metallic shield so as to expose an exposed portion of said metallic shield and with a rigid sleeve between said metallic shield and said inner dielectric of each of said cables;

positioning said exposed portion of each of said metallic shields on an elongated, generally planar ground plate of said terminating member, said terminating member having a pair of crimp arms projecting from opposite edges of said ground plate near one end thereof; and crimping said crimp arms into engagement with said exposed portion of said metallic shield of each of said cables thereby clamping said metallic shields between said crimp arms and said sleeves to thereby position and retain said cables on said ground plate and whereby said rigid sleeves protect said inner dielectrics from being damaged by said crimp arms.

23. The method of claim 22 wherein said rigid sleeve is a metallic sleeve.

24. The method of claim 23 wherein an additional pair of cables are to be terminated to said conductive terminating member, each of said additional pair of cables including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and each of said additional cables having an additional rigid sleeve disposed between said additional metallic shield and said additional inner dielectric and wherein said ground plate has a pair of additional crimp arms projecting from opposite edges of said ground plate on a side of said ground plate opposite to the side from which said pair of crimp arms project and wherein said method further includes positioning said additional exposed portion of said additional metallic shield of each of said additional cables on said ground plate and crimping said additional crimp arms into engagement with said additional exposed portions of said additional metallic shields thereby clamping said additional metallic shields between said additional crimp arms and said additional sleeves.

25. The method of claim 24 wherein said pair of crimp arms and said pair of additional crimp arms are spaced longitudinally on said ground plate with respect to each other.

26. The method of claim 24 wherein said rigid sleeves are portions of a unitary dual-sleeve member having a pair of sleeve portions joined by a web, each of said sleeve portions being positioned between one of said metallic shields and one of said inner dielectrics of said pair of cables and wherein said additional rigid sleeves are portions of an additional unitary dual-sleeve member having a pair of additional sleeve portions joined by an additional web, each of said additional sleeve portions being positioned between one of said additional metallic shields and one of said additional inner dielectrics of said pair of additional cables.

27. The method of claim 26 wherein said exposed portions of said metallic shields are severed along a longitudinal portion of said exposed portions of said metallic shields to permit the installing of said sleeve portions of said unitary dual-sleeve member between said metallic shield and said inner dielectric of each of said pair of cables and wherein said additional exposed portions of said additional metallic shields are severed along a longitudinal portion of said additional exposed portions of said additional metallic shields to permit the installing of said additional sleeve portions of said additional unitary dual-sleeve member between said additional metallic shield and said additional inner dielectric of each of said pair of additional cables.

28. The method of claim 26 including interengaging holding means between said ground plate and said unitary dual-sleeve member for holding said dual-sleeve member on said ground plate and additional interengaging holding means between said ground plate and said additional unitary dual-sleeve member for holding said additional dual-sleeve member on said ground plate.

29. The method of claim 28 wherein said holding means includes a spring clip on said ground plate engageable with said web of said dual-sleeve member and wherein said additional holding means includes an additional spring clip on said ground plate engageable with said additional web of said additional dual-sleeve member.

30. The method of claim 22 wherein said rigid sleeves are portions of a unitary dual-sleeve member having a pair of sleeve portions joined by a web, each of said sleeve portions being positioned between one of said metallic shields and one of said inner dielectrics of said pair of cables.

31. The method of claim 30 wherein said exposed portions of said metallic shields are severed along a longitudinal portion of said exposed portions of said metallic shields to permit the installing of said sleeve portions of said unitary dual-sleeve member between said metallic shield and said inner dielectric of each of said pair of cables.

32. The method of claim 30 including interengaging holding means between said ground plate and said unitary dual-sleeve member for holding said dual-sleeve member on said ground plate.

33. The method of claim 32 wherein said holding means includes a spring clip on said ground plate engageable with said web of said dual-sleeve member.

* * * * *